US005361886A

United States Patent [19]

Thomas et al.

[11] Patent Number: 5,361,886

[45] Date of Patent: Nov. 8, 1994

[54] METHOD AND APPARATUS FOR EXAMINING COINS

[75] Inventors: Hartmut Thomas; Jens Hertlein; Eckhardt Seher, all of Berlin, Germany

[73] Assignee: ACT Gesellschaft fuer Soft- und Hardware-systeme GmbH, Berlin, Germany

[21] Appl. No.: 857,195

[22] Filed: Mar. 25, 1992

[30] Foreign Application Priority Data

Apr. 11, 1991 [DE] Germany ..... 4112106
Nov. 27, 1991 [DE] Germany ..... 4139503

[51] Int. Cl.[5] ..... G07D 5/02; G07D 5/08
[52] U.S. Cl. ..... 194/317; 194/337
[58] Field of Search ..... 194/317, 328, 330, 334, 194/337

[56] References Cited

U.S. PATENT DOCUMENTS 2,165,471 7/1939 Freeman et al. ..... 194/328
4,815,579 3/1989 Fritz ..... 194/334 X
4,819,780 4/1989 Trummer et al. ..... 194/317

FOREIGN PATENT DOCUMENTS 2709315 8/1978 Germany ..... 194/328

*Primary Examiner*—F. J. Bartuska
*Attorney, Agent, or Firm*—Jordan and Hamburg

[57] ABSTRACT

In a method and an apparatus for examining the genuineness and the value of coins using inductive and opto-electronic devices, the coin diameter, the minting and the nature of the material are determined and evaluated within a test cycle, in which the coin is taken up, centered, clamped and turned through 360°. The coin diameter is ascertained and checked by way of the angle of twist between two disks, which are disposed so that they can be twisted relatively to one another. The apparatus ensures an accurately centered and vibrationless clamping of the coin for an opto-electronic scanning and the inductive identification of the material.

15 Claims, 4 Drawing Sheets

Figure 1:
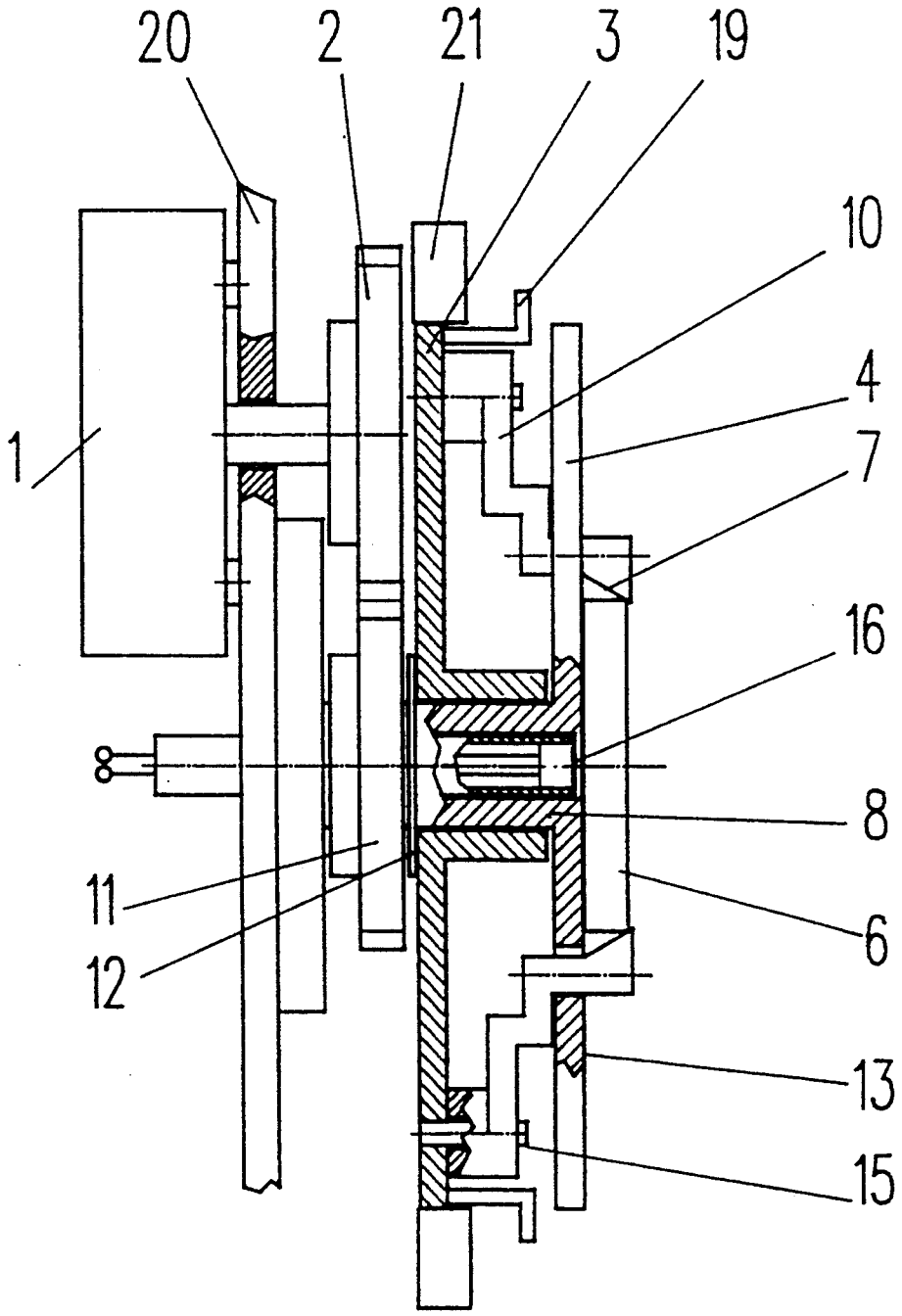

Fig. 2
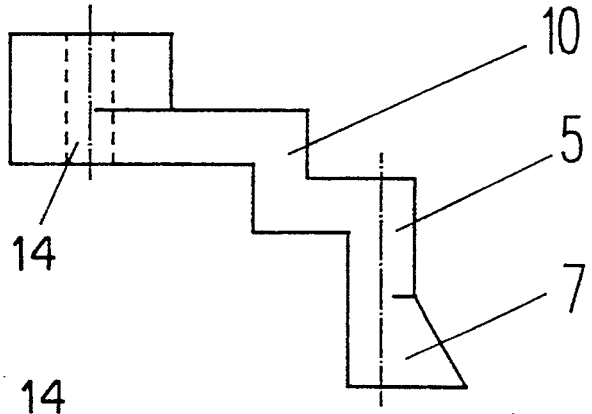
Fig. 3
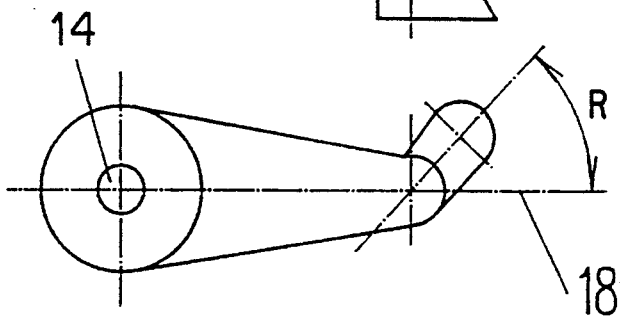
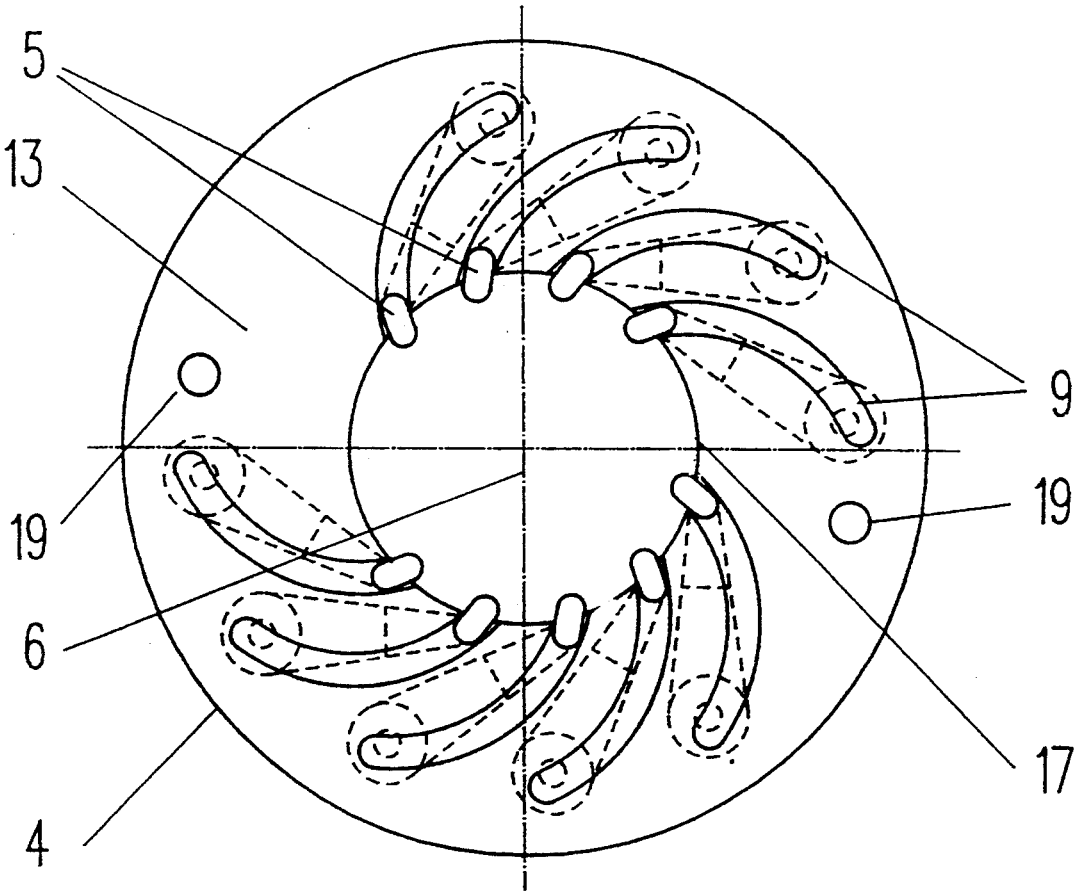
Fig. 4

METHOD AND APPARATUS FOR EXAMINING COINS

FIELD OF THE INVENTION

The invention relates to a method and an apparatus for examining coins using inductive and opto-electronic means.

BACKGROUND OF THE INVENTION

To examine the genuineness and value of coins, different examining systems and examining equipment are already known, which detect and evaluate the characterizing distinguishing features of coins, such as the geometric dimensions, the material, the weight or the milled edge.

The examining methods can therefore be divided into mechanical, inductive and optical method, the mechanical construction of the coin-examining apparatus logically being determined by the examining method used.

In the case of optical methods of examining, it is known that the coins to be examined roll or are conducted on a guiding channel past optical sensors in order to detect characteristic points and/or parameters of the coin. The accuracy of the measurement is determined here by the number of the sensors present and by the length of the guiding channel. It follows from this that, at very high degrees of accuracy, a larger number of optical sensors and a guiding channel of appropriate length are required, which, in turn, lead to relatively large and expensive examining equipment. Small, compact and accurate examining facilities can be realized only with great difficulty with this technique.

Other solutions are known, in which the coins are clamped between three wedge-shaped rollers, which are disposed in the shape of a triangle and are turned through the agency of a motorized driving mechanism of one of these rollers due to friction pairing between the driven roller and the coin.

The mechanical effort involved in realizing a plane-parallel and centric running of the coin with this arrangement of rollers is very high and susceptible to failure, since the coin driving mechanism is a frictional wheel driving mechanism.

Furthermore, the degree to which the coins are soiled, which negatively affects the friction pairing with respect to the constancy of the rotational speed, must be taken into consideration.

Increasingly, opto-electronic coin-examining equipment and methods are also being used, which make it possible to scan accurately the minting or selected sections of the minting and/or the milled edge of a coin.

This equipment ensures a highly accurate determination of the genuineness and the value of a coin and leads to equipment configurations with a high degree of accuracy in the identification of genuine money and the rejection of counterfeit money.

For opto-electronic coin-examining equipment working with high accuracy, an accurate and exact gripping and centering of the coin to be examined is, however, a prerequisite for the subsequent opto-electronic scanning, since the smallest inaccuracies and deviations in the gripping, centering and examining of the coin during the scanning process lead to wrong interpretations and breakdowns.

Particularly in the case of mobile coin examining equipment with opto-electronic examining systems, care must be taken to ensure that, despite the vibrations and oscillations, which cannot be avoided, the exact mounting and guidance of the coins during the examining cycle is ensured and wrong interpretations are reliably avoided.

An important disadvantage of known coin-examining equipment consists particularly in that, for examining further characteristic parameters, such as the material of the coin, additional or separate examining sections must be provided in the equipment in question. These additional examining sections, in turn, require further construction space, of which there is anyhow very little to spare.

SUMMARY OF THE INVENTION

It is therefore an object of the invention to propose a method and an apparatus, which, without limiting the examining possibilities for the relevant parameters of a coin, has a narrow, space-saving construction and, with a significantly improved, recognition of genuine coins and rejection of counterfeit coins, permits several test parameters to be determined and evaluated simultaneously.

One embodiment of the apparatus has structural shape, which is oriented towards a very narrow space and makes it possible, within a examining cycle, in which the coin is rotated through 360°, to scan the coin opto-electronically and to evaluate the minting and, at the same time, to ascertain the diameter and the nature of the material of the coin and to evaluate and examine these parameters with the help of computational means.

The respective diameter of the coin, which is to be examined, is advantageously determined in the centering phase of the coin that is supplied. This is done by measuring the value of the twisting between two disks, which are disposed so that they can be twisted relative to one another, after the centering process, that is, after the driving lugs are brought together by the rotation of the disk, which serves as a receiving disk, up to the center of this disk and after said driving lugs uniformly enclose the circumference of the coin and, by these means, center the coin accurately and bring about a rotationally coupling with the second disk. For this purpose each of the two disks is provided with a marking which is detected by means of a sensing system.

In order to support the exact determination of the angle of rotation for checking the diameter of the coin in this centering phase, the second disk, which is mounted so that it can rotate independently on a common axis together with the receiving disk, can additionally be fixed by a limiting force restrictor with a precisely defined torque. Due to the kinematic rotational connection between the two disks, which arises at the end of the centering process over the centered, clamped coin, the higher torque, which is applied by the limiting force restrictor, is overcome when all driving lugs rest on the edge of the coin and the second disk is rotated further synchronously with the receiving disk.

An advantageous solution for producing the necessary rotational motion of the receiving disk, against which the coin that is to be examined lies in plane parallel fashion, consists of the use of a stepping motor as driving organ. By counting the number of steps from the start of the rotational motion of the receiving disk through 360° up to the moment, at which the second disk is also set in rotational motion, the mutual twisting of the disks can be determined relatively simply and the coin diameter can be calculated from this with the help of computational means. Instead of stepping motors, it is also possible to use analog motors with an incremental measuring system as a driving organ.

When the coin is clamped centrally, the composition of its material is also examined. The examination of the material is carried out in a known manner with the help of inductive material identification.

Previously known electronic or electro-mechanical examining equipment provides a separate examining sector within the examining equipment for the material identification. On the other hand, pursuant to a preferred embodiment of the invention, the examining equipment has a hollow shaft, into which a cylindrical, fixed inductance for material identification is inserted.

The conducting slopes, which are provided pursuant to the invention at the free ends of the driving lugs, are particularly advantageous. As a result of these slopes, the coin lies in a plane parallel fashion against the receiving disk and covers the inductance completely. The coin accordingly has a precisely defined position with a largely reduced dielectric within the inductive field, so that the permissible deviation, which is relatively large in the known examining facilities, through which the coin passes with practically no defined bearing surface, is relatively large, can be reduced greatly.

The apparatus for carrying out the method consists of two disks, which are disposed so that they can be rotated independently of one another and are mounted on a common axis of rotation, at least one disk being provided with circular, elongated holes, which start out from a given diameter and are directed radially towards the center of the disk.

Driving lugs for accommodating, centering and holding the coin during the examining cycle, during which the coin is turned through 360°, are passed through the elongated holes of the disk, which serves as receiving disk. Said driving lugs are fastened in tillable levers, which are hinged at the second disk.

Pursuant to a further variation of an embodiment of the invention, elongated holes, through which extensions of the driving lugs are passed, are provided in the second disk in an arrangement analogous to that of the receiving disk. At these extensions of the driving lugs, springs are hinged, which are disposed on the back of the second disk and fix the driving lugs in their starting position, which corresponds to the "open" position of the apparatus.

The arc-shaped elongated holes, which start out from a smallest diameter in the vicinity of the center of the disks in the direction of a larger diameter in the area of the edge of the disk, correspond indirectly to the respective diameter of the smallest and largest coin, which is to be detected and examined.

As already explained, the coupling or rotating connection between the two disks is brought about by way of the driving lugs. If the first disk, that is, the receiving disk, which is connected directly with the driving shaft of an electric motor, preferably a stepping motor or is rigidly disposed on a shaft that is common to the two disks, is driven in the clockwise direction, the driving lugs, which are guided in the circular, elongated holes, move towards the center of the disks, until their twisting motion is blocked by the end of the circular, elongated holes or by the edge of a coin. After that, the two disks together rotate further in the given direction of rotation.

The entering coin initially is taken up by a few driving lugs. Subsequently, it is centered precisely by the rotating movement of the receiving disk and the driving lugs, which tilt towards the center of the disk. After that, it is turned in plane parallel fashion, so that the desired parameters of the surface structure can be scanned exactly with high representation by the opto-electronic means.

The opening of the apparatus or of the driving lugs occurs through changing the direction of rotation of the receiving disk.

To increase the contacting pressure of the driving lugs on the edge of the coin, it is advantageous that the springs, which hold the driving lugs in their starting position, be mounted in a tilting arrangement and, when the tilting point is exceeded, act as additional holding force on the edge of the coin.

Likewise, it is possible, through incorporating a spring, to produce a tension between the two disks. This tension twists the two disks relative to one another and thus produces a preadjustment of the rectangular levers with the driving lugs.

The spring is disposed so that the driving lugs act with increased contacting pressure on the coins.

Pursuant to a preferred embodiment of the invention, the receiving disk is fastened directly to an axis of rotation, which is driven over a set of gears by a motor and on which the second disk, to which the rectangular levers with the driving lugs are rotatably hinged, is mounted so that it can rotate independently. As already explained, the common axis of rotation preferably is constructed as a hollow shaft, in which a fixed inductance for the inductive material recognition is inserted.

According to a further inventive characteristic, the free ends of the driving lugs are equipped, for the purpose of accommodating, centering and holding/clamping the coin that is to be examined, with a conducting slope, which is directed to the bearing surface of the receiving disk. The conducting slopes advisably are disposed an angle to the longitudinal axis of the rectangular levers, which corresponds to the tangent to the circular, longitudinal holes in the receiving disk.

This advantageous construction of the driving lugs supports the reliable taking hold of the coins, which are to be examined, and ensures that they are constantly pulled by this conducting slope in a plane parallel and centered position against the bearing surface of the receiving disk. This is particularly important for vibrationless clamping, especially for mobile coin examining equipment and for the inductive material identification with respect to the accurately determinable dielectric within the inductive field.

In comparison to known solutions, the whole of the construction and the manufacturing expense of the examining equipment are minimized by the invention and a high running accuracy of the coin during the examining process is achieved. Compared to solutions with rails, on which the coins run, and triangularly disposed rolls, the inventive solution requires very little space in order to take hold of the coin to be examined after it enters the opto-electronic examining equipment, to center it and turn it with high accuracy in plane parallel fashion and centrically by more than 360° for scanning selected parameters, such as the minting or parts thereof.

Compared to previously known coin examining equipment, the invention ensures a far more reliable recognition of genuine money and rejection of counterfeit money.

BRIEF FIGURE DESCRIPTION

Figure 5:
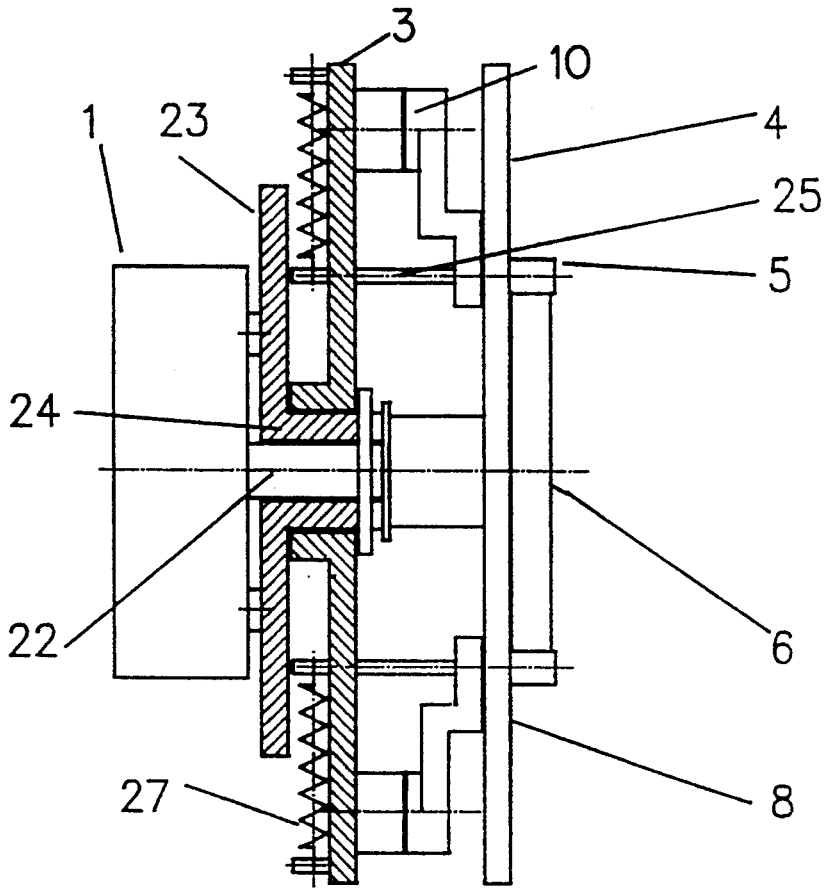
Figure 6:
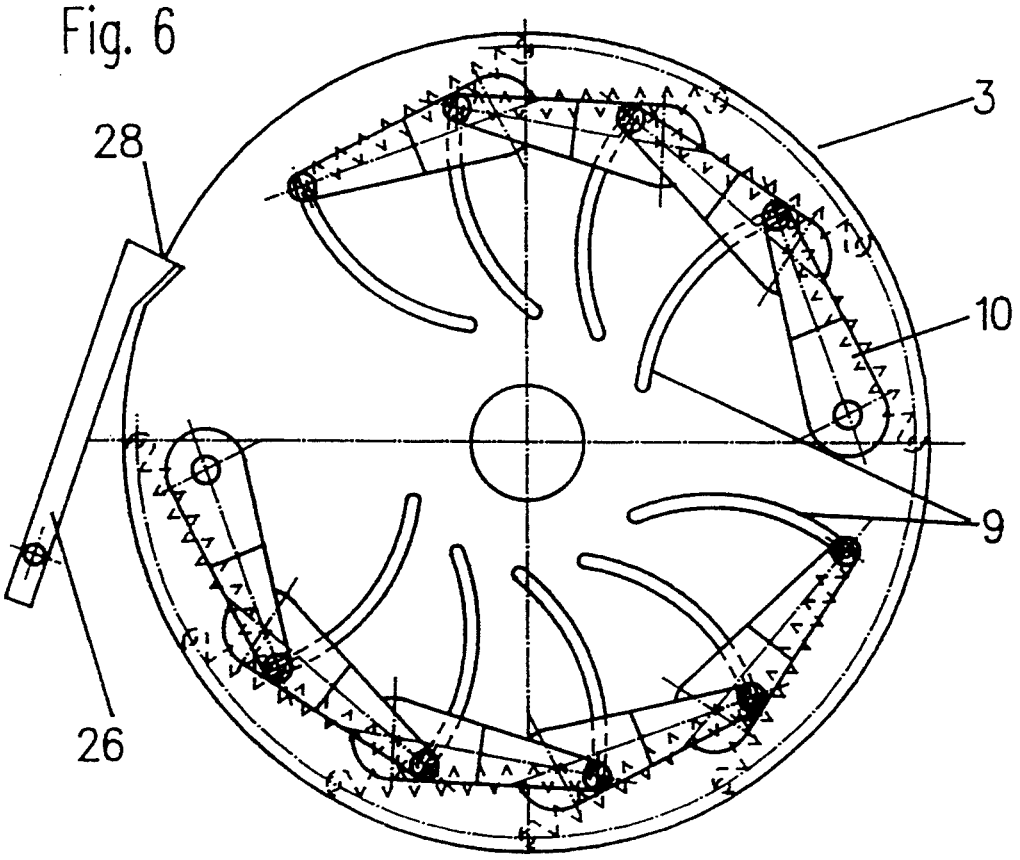

The invention is to be described in greater detail in the following by means of an embodiment. In the associated drawings, FIG. 1 is a diagrammatic representation of a preferred construction of the examining equipment in partial section, FIG. 2 is a side view of a rectangular lever with the driving lug, FIG. 3 is the plan view of the rectangular lever, FIG. 4 is the front view of the receiving disk with a clamped and centered coin, FIG. 5 shows a further embodiment of the inventive apparatus, FIG. 6 shows the second disk with the hinged rectangular levers in the "open" position and FIG. 7 is the front view of the receiving disk, to which a coin has been supplied, before the start of the centering and clamping process.

DETAILED DISCLOSURE OF THE INVENTION

Figure 7:
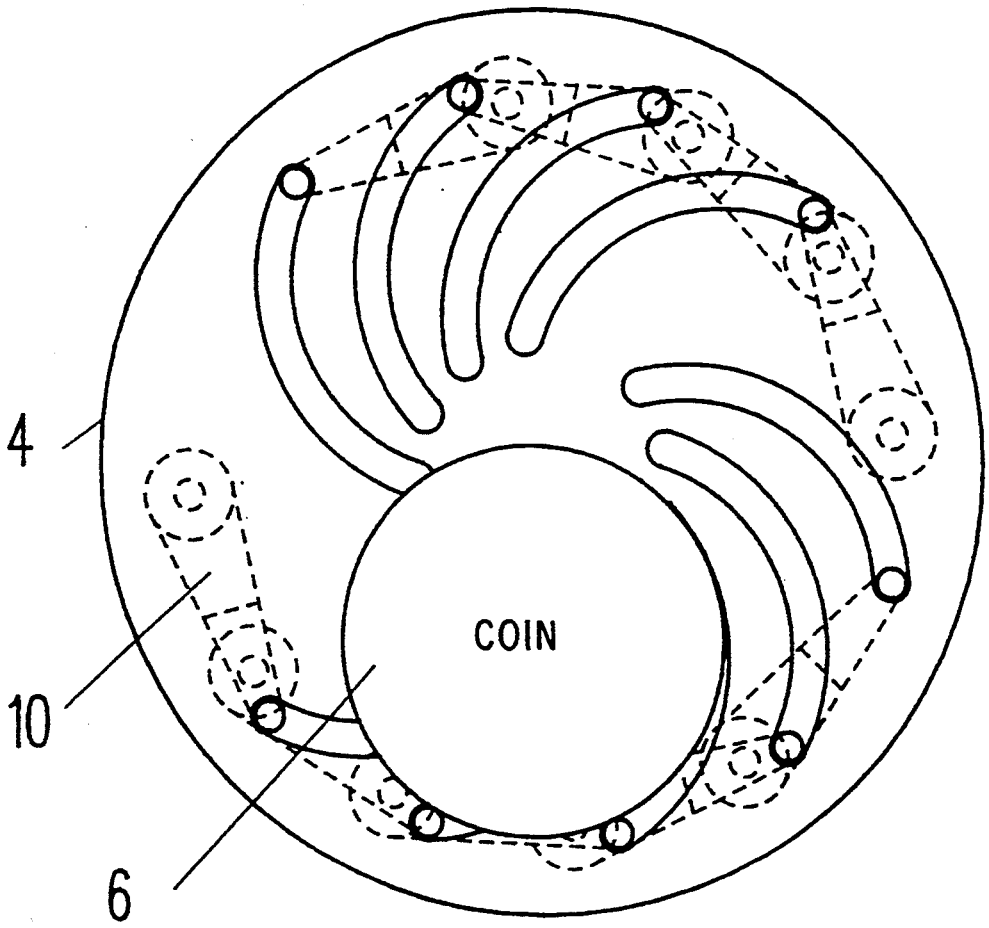

The apparatus, shown in FIGS. 1 to 7, is disposed, for example, in an opto-electronic coin-examining equipment at an angle of <20° to the perpendicular, so that, as shown in FIG. 7, the coins, which are supplied over an incline, lie totally on the bearing surface 13 of the receiving disk 4 and a plane parallel accommodation is ensured. The driving lugs 5, which are passed through the circular, elongated holes 9 in the receiving disk 4, are in the open position, that is, in their starting position, which corresponds to a free space, which is related to the diameter of the largest coin. After the coin 6 has entered, it lies with its edge 17 practically on the driving lugs 5 of the lower rectangular levers 10 and totally against the bearing surface 13 of the disk 4.

The receiving disk 4 is mounted, so that it cannot twist, on the hollow shaft 8—FIG. 1—, which is driven, after taking a coin 6 that is to be examined, in a periodic, revolving rotational motion of 360° by a set of gears 2, 11 of a gear drive by a driving motor 1, preferably a stepping motor or an analog motor with an incremental measuring system. The driving motor I is mounted on an receiving plate 20, which at the same time serves as the end shield for mounting the hollow shaft 8. On the same hollow shaft 1, there is a second disk 3, which can rotate independently and is secured axially by a retaining ring 12 and on which the rectangular lever 10 is tiltably hinged by means of the pivots 15, which engage appropriate boreholes 14 in the rectangular levers 10. Both disks 3, 4 are equipped with sensors 19. Disk 3 can additionally be fixed in its starting position by a limiting force restrictor 21.

The receiving disk 4 is provided with circular, elongated holes 9, which radiate out from the center of the disk 4 to the periphery, as shown in FIG. 4. Through these elongated holes 9 are passed the driving lugs 5 of the rectangular levers 10, which are passed through the elongated holes 9 when opening and closing the apparatus for the purpose of accommodating the coin 6 to be tested or issuing the coin 6 that has been tested.

At the free ends of the driving lugs 5, conducting slopes 7 are provided, which are directed towards the bearing surface 13 of the receiving disk 4 and are disposed at an angle to the longitudinal axis 18 of the rectangular levers 10, as shown in FIGS. 2 and 3.

At the commencement of the examining process, the starting position of the disk 3 is advantageously fixed through the limiting force restrictor 21 with defined friction and torque, while the driving lugs 5 are in their "open" position in the outer periphery of the receiving disk 4 for accommodating a coin 6.

The entering coin 6 initially is then laid hold of by the driving lugs 5 lying in the entering direction and lies loosely against the bearing surface 13 of the receiving disk 4. For this purpose, the examining equipment is disposed in the equipment as a whole at an angle of <20°, which reliably ensures that the coin 6 lies loosely against the bearing surface 13.

As the 360° rotational motion starts, the driving lugs 5, guided by the circular, elongated holes 9 in the receiving disk 4, are guided in diaphragm fashion toward the center of the disk 4 and the coin 6 is centered until all the driving lugs 5 lie uniformly against the edge 17 of the coin 6. By means of this process, the coin 6 is pulled by the conducting slope 7, against which the edge 17 of the coin is practically lying, to the bearing surface 13 of the receiving disk. As a result, a precisely defined and vibration-free, stable emplacement and clamping of the coin 6 is ensured for the subsequent opto-electronic scanning of the minting and/or of the milled edge of the coin 6.

When all the driving lugs 5 lie against the edge 17 of the coin 6, the centering process is practically completed. A kinematic, rotating connection with disk 3 is established by way of the coin 6, the driving lugs 5 and the rectangular levers 10 and, after the defined friction/torque, which is applied by the limiting force restrictor 21, is overcome, the disk 3 is also set in rotary motion synchronously with the receiving disk 4. At the same time, the higher torque occurring here supports the reliable and stable clamping of the coin 6 with an exactly, plane parallel emplacement on the bearing surface 13 of the disk 4 for the subsequent opto-electronic scanning.

When the centering of the coin 6 is concluded and the kinematic, rotating connection between the receiving disk 4 and the disk 3 is established by way of the centered coin 6 and the driving lugs 5, which lie completely against the edge 17 of the coin 6, the angle of rotation of the mutual twisting between the two disks 3, 4 is determined with the help of a system of sensors and by determining and counting out the steps of a stepping motor, which is used as driving motor 1. From this, the respective diameter of the coin 6, which is to be examined, is determined with computational means.

Pursuant to the invention, a fixed inductance 16 for the inductive identification of the material is disposed in the hollow shalt 8. Testing the material of the coin 6 advisably is carried out at the end of the centering process, when the coin 6 lies completely and in plane parallel fashion against the bearing surface 13 and completely and steadily covers the fixed inductance 16.

For the construction of the inventive apparatus of FIG. 5, the motor shaft 22 of the driving motor 1 is connected directly to the receiving disk 4. The driving motor 1, in turn, is fastened to a receiving plate 13, which is equipped with a bearing hub 24. The second disk 3, to which the rectangular lever 10 is rotatably hinged, is mounted so that it can rotate independently on this bearing hub 24. Similarly to the receiving disk 4, the disk 3 is also provided, as shown in FIG. 6, with circular, diaphragm-like longitudinal holes 9, which are directed towards the center of the disk 3 and through which the extensions 25 of the driving lugs 5 are passed. On the back of the disk 3, springs 27 are hinged to the extensions of the driving lugs 5 in such a manner that, together with the rectangular levers, they act as a tilting-clamping arrangement and, during the closing of the apparatus, support the lever movement of the rectangular levers 10, which is directed to the center of the disks 3, 4.

By these means, it is ensured that the rectangular levers 10 with the driving lugs 5, in their starting position, which corresponds to the "open" position of the apparatus, remain strictly mechanical and, after the motor 1 is started and the tilting point is overcome, that the movement of the levers 10 and the driving lugs 5, which is directed to the center of the disk 4, is supported and, at the same time, the lever force acting on the edge 17 of the coin 6 is reinforced.

As the motor 1 and the disk 4 start, the disk 3 is held by an associated catch 26, which engages an appropriate recess 28 in the casing of the disk 3, until the tilting point of the springs 27 is reached. By these means, the whole of the clamping and centering process of the coin 6, which has entered the apparatus, is supported.

When all the driving lugs 5 lie against the edge 17 of the coin 6, the rotational movement of the disk 4 is transferred to the disk 3 and the whole of the mechanical system is turned in the direction specified by the motor 1 and with the appropriate speed. With the help of opto-electronic examining and evaluating equipment, which is not an object of the invention, the surface structure of the coin or parts thereof, for example, can be determined and evaluated precisely and with high accuracy.

For the purpose of opening the apparatus and of the therewith possible issuing of the coin 6, the direction of rotation of the motor 1 is changed and the disk 3 is arrested for this process once again by the catch 26.

At the same time, the driving lugs 5, by means of the circular, elongated holes 9 and supported by the springs 27, are returned to their starting positions.

Instead of the catch 26, it is also possible to provide a controllable brake, which acts together with the casing of the disk 3.

We claim:

1. An apparatus for testing the genuineness and the value of coins, comprising first and second independently rotatable disks on a common axis and of which at least said first disk, which serves as a coin receiving disk, is equipped with arcuate elongated holes, said holes starting from a given diameter and being directed in radiating fashion toward the center of the first disk, driving lugs or rectangular levers rotatably hinged at the second disk and passing through said holes, a motor, and a hollow shaft driven by the motor, said shaft serving as a common axis on which the first disk is mounted so that it cannot rotate independently therefrom, said second disk being mounted so that is can freely rotate independently on the shaft, the free ends of the driving lugs having conducting slopes.

2. The apparatus of claim 1 wherein the first disk has a bearing surface, the conducting slopes of the driving lugs are directed towards the bearing surface of the first disk and are disposed at an angle to the longitudinal axis of the rectangular lever, said angle corresponding to the tangent of the curved path of the arcuate elongated holes in the first disk.

3. The apparatus of claim 1 wherein the second disk is provided with arcuate elongated holes, through which extensions of the driving lugs pass, said lugs being resiliently held by springs.

4. The apparatus of claim 1 wherein the driving motor is a stepping motor.

5. The apparatus of claim 1 wherein the second disk is held in position a limiting force restrictor with a defined friction/torque.

6. The apparatus of claim 1 wherein the first disk is directly fastened to the shaft of the motor, the motor being mounted on a receiving plate having a bearing and the second disk being mounted so that it can freely rotate independently on said bearing.

7. The apparatus of claim 1 comprising a latch engaging a recess in the outer surface of the second disk, said second disk being mounted so that it is free to rotate independently, and further comprising a spring mounted between the disks to place first and second disks under tension.

8. The apparatus of claim 1 further comprising an inductance mounted in said hollow shaft for testing the material of a coin inserted in said apparatus.

9. An apparatus for testing coins, comprising first and second parallel spaced apart disks, said first disk having a coin receiving surface on the side thereof opposite said second disk, a plurality of elongated arcuate slots in said first disk directed toward the center of said disk, a plurality of driving members pivoted to said second disk and having coin holding portions extending through separate ones of said slots, means for providing relative rotation between said first and second disks, whereby said driving members are rotated about their respective pivots and said coin holding portions move radially of said disks in their respective slots, means for inhibiting movement of one of said disks, and testing means mounted to said apparatus for testing a coin held by said coin holding portions.

10. The apparatus of claim 9 comprising a motor, said means for relatively rotating said first and second disks comprising a hollow shaft coupling said motor to said first disk, said second disk being freely rotatable with respect to said shaft, said means for inhibiting movement comprising limiting force restricting means coupled to inhibit rotation of said second disk, and said testing means comprising an inductor mounted in said hollow shaft.

11. The apparatus of claim 9 wherein said coin holding portions of said driving members have sloped inner end surfaces for grasping a coin on said surface.

12. The apparatus of claim 9 wherein said testing means comprises means for determining the relative angular displacement of said first and second disks upon relative rotation of said disks in one direction, until said coin holding portions engage the rim of a coin on said surface, whereby said angular displacement is a measure of the diameter of said coin.

13. The apparatus of claim 9 wherein said second disk has elongated arcuate slots directed toward the center of said second disk, said driving members having pins extending through the slots of said second disk, and further comprising spring means coupled to resiliently bias said pins radially outward of said second disk.

14. The apparatus of claim 13 further comprising a latch for releasably holding said second disk.

15. A method for positioning and computing a diameter of a coin comprising:

rotating the coin;

centering the coin during the step of rotating;

determining an angle of twist of a twisting means contacting the coin, once the coin is centered; and computing a diameter of the coin from the angle of twist.

* * * * *